US010094607B2

(12) United States Patent
Broadbent

(10) Patent No.: US 10,094,607 B2
(45) Date of Patent: Oct. 9, 2018

(54) ICE MAKER WITH SLUSH-AVOIDING SUMP

(71) Applicant: True Manufacturing Co., Inc., O'Fallon, MO (US)

(72) Inventor: John Broadbent, Denver, CO (US)

( * ) Notice: Subject to any disclaimer, the term of this patent is extended or adjusted under 35 U.S.C. 154(b) by 0 days.

(21) Appl. No.: 15/283,815

(22) Filed: Oct. 3, 2016

(65) Prior Publication Data

US 2017/0023284 A1 Jan. 26, 2017

Related U.S. Application Data

(62) Division of application No. 14/086,576, filed on Nov. 21, 2013, now abandoned.

(60) Provisional application No. 61/817,069, filed on Apr. 29, 2013, provisional application No. 61/758,072, filed on Jan. 29, 2013, provisional application No. 61/729,215, filed on Nov. 21, 2012, provisional application No. 61/729,187, filed on Nov. 21, 2012, provisional application No. 61/729,222, filed on Nov. 21, 2012.

(51) Int. Cl.

| | |
|---|---|
| ***F25C 1/25*** | (2018.01) |
| ***F25C 1/04*** | (2018.01) |
| ***F25C 1/22*** | (2018.01) |
| ***F25C 1/18*** | (2006.01) |
| ***F25C 5/182*** | (2018.01) |

(52) U.S. Cl.

CPC ..... *F25C 1/225* (2013.01); *F25C 1/04* (2013.01); *F25C 1/22* (2013.01); *F25C 1/25* (2018.01); *F25C 5/182* (2013.01); *F25C 2400/14* (2013.01); *F25C 2500/08* (2013.01)

(58) Field of Classification Search

CPC .. F25C 2400/14; F25C 2500/08; F25C 5/182; F25C 1/22; F25C 5/007; F25C 1/045; F25C 1/25

USPC ..... 62/347

See application file for complete search history.

(56) References Cited

U.S. PATENT DOCUMENTS

| | | | | |
|---|---|---|---|---|
| 2004/0226311 | A1* | 11/2004 | Ishitomi | F25C 1/045 62/348 |
| 2005/0155360 | A1* | 7/2005 | Yoshida | F25C 1/12 62/135 |
| 2012/0024000 | A1 | 2/2012 | Lee et al. | |

FOREIGN PATENT DOCUMENTS

| | | |
|---|---|---|
| RU | 2235951 | 9/2004 |
| WO | 2014081990 | 5/2014 |

* cited by examiner

*Primary Examiner* — Frantz Jules
*Assistant Examiner* — Steve Tanenbaum
(74) *Attorney, Agent, or Firm* — Bryan Cave Leighton PaisnerLLP

(57) ABSTRACT

A sump for use in an ice maker, the sump adapted to hold a mass of water, wherein the ice maker freezes some or all of the mass of water into ice. The sump includes a recirculation area and one or more additional areas separated from the recirculation area. The recirculation area and the one or more additional areas are in fluid communication via one or more passageways. The recirculation area is adapted to hold and receive a first portion of the mass of water having a first mass. The one or more additional areas are adapted to hold a second portion of the mass of water having a second mass. Thus, if the first portion of water forms into slush, the second portion of water can be recirculated to melt the slush.

17 Claims, 15 Drawing Sheets

ICE MAKER WITH SLUSH-AVOIDING SUMP

FIELD OF THE INVENTION

This invention relates generally to ice making machines and, more particularly, to an ice maker that comprises an improved sump design for avoiding, preventing, reducing and/or eliminating slush.

BACKGROUND OF THE INVENTION

Ice making machines, or ice makers, typically comprise a refrigeration and ice making system that employs a source of refrigerant flowing serially through a compressor, a condenser, a thermal expansion valve, and an evaporator assembly. Thermally coupled to the evaporator assembly is a freeze plate comprising a lattice-type cube mold. Additionally, typical ice makers employ gravity water flow and ice harvest systems that are well known and in extensive use. Ice makers having such a refrigeration and ice making system are often disposed on top of ice storage bins, where ice that has been harvested is stored until it is needed. Such ice makers have received wide acceptance and are particularly desirable for commercial installations such as restaurants, bars, motels and various beverage retailers having a high and continuous demand for fresh ice.

In these ice makers, water is supplied at the top of a freeze plate which directs the water in a tortuous path toward a water pump. A portion of the supplied water collects on the freeze plate, freezes into ice and is identified as sufficiently frozen by suitable means whereupon the freeze plate is defrosted such that the ice is slightly melted and discharged therefrom into an ice storage bin. Typically, these ice machines can be classified according to the type of ice they make. One such type is a grid style ice maker which makes generally square ice cubes that form within individual grids of the freeze plate which then form into a continuous sheet of ice cubes as the thickness of the ice increases beyond that of the freeze plate. After harvesting, the sheet of ice cubes will break into individual cubes as they fall into the ice storage bin. Another type of ice maker is an individual ice cube maker which makes generally square ice cubes that form within individual grids of the freeze plate which do not form into a continuous sheet of ice cubes. Therefore, upon harvest individual ice cubes fall from the freeze plate and into the ice storage bin. Control means are provided to control the operation of the ice maker to ensure a constant supply of ice. Various embodiments of the present invention can be adapted to either type of ice maker, and to others not identified, without departing from the scope of the present invention.

Traditionally, the principal components of a refrigeration and ice making system for use in an ice maker include a source of refrigerant flowing serially through a compressor, a condenser, a thermal expansion valve, and an evaporator assembly. The evaporator is thermally coupled to the freeze plate in order to freeze the supplied water into ice.

The cooling cycle of the ice maker is comprised of two sub-cycles, the sensible cooling cycle and the latent cooling cycle. During the sensible cooling cycle the supplied water is and continuously recirculated by a water pump across the freeze plate and back to the sump thereby cooling the supplied water. Once the supplied water reaches the freezing point the supplied water begins to freeze in the freeze plate, the latent cooling cycle begins.

However, in certain situations, the water in the sump can fall below the freezing point of water before ice begins to freeze in the freeze plate. As a result, it is not uncommon for the water in the sump to begin "slush up." A "slush-up" situation happens when the water that is being recirculated over the freeze plate sub-cools below 0° C. (32° F.) and then suddenly begins to freeze. Ice crystals in the sub-cooled water can quickly propagate through all of the water in the sump, turning all of the sub-cooled water to slush. When this happens, the water cannot be pumped from the sump across the freeze plate, thus terminating any water flow in the ice maker. Accordingly, the ice machine will stop refrigerating the water and ice production will cease. This "slush up"condition can last for several minutes until the water in the sump warms and the slush thaws back into liquid water. This "slush up" condition represents inefficiency in the cooling cycle because the water is not being cooled for a period of time. Additionally, the time required to produce ice is extended until the slush dissipates enough for the water to resume flowing through the ice making system.

Prior art ice machines have attempted to solve this problem by turning off the water pump for a short period of time during each ice production cycle. By not flowing water over the freeze plate for a short period of time, the temperature of the evaporator can be reduced such that when the water pump is turned back on and water again flows over the freeze plate, the water will freeze on the freeze plate more quickly and the water will not sub-cool. This approach requires a properly calibrated temperature sensor to work, and turning off the water pump lengthens the freeze cycle and thus is not the most efficient way to make ice. However, this method does prevent the "slush up" problem.

Therefore, there is a need in the art to prevent a "slush up" in the sump of an ice maker without turning off the water pump thus avoiding the resulting delay in the ice making process. Likewise, there is a need in the art to prevent a "slush up" in the sump of an ice maker without the use of an additional thermostat which adds complexity and cost to the system and has the potential to fail or be mis-calibrated.

SUMMARY OF THE INVENTION

Briefly, therefore, one embodiment of the present invention is directed to a sump for use in an ice maker, the sump adapted to hold a mass of water, wherein the ice maker freezes some or all of the mass of water into ice. The sump comprises a recirculation area and one or more additional areas separated from the recirculation area, wherein the recirculation area and the one or more additional areas are in fluid communication via one or more passageways.

Another embodiment of the present invention is directed to an ice maker for forming ice using a refrigerant capable of transitioning between liquid and gaseous states. The ice maker includes a compressor, a condenser, a thermal expansion valve, and an evaporator assembly. The ice maker also includes a freeze plate thermally coupled to the evaporator assembly, a sump located below the freeze plate adapted to hold a mass of water wherein the ice maker freezes some or all of the mass of water into ice, and a water pump. The sump comprises a recirculation area and one or more additional areas separated from the recirculation area, wherein the recirculation area and the one or more additional areas are in fluid communication via one or more passageways. The recirculation area has a first volume such that the recirculation area is adapted to hold and receive a first portion of the mass of water wherein the first portion has a first mass of water. The one or more additional areas have a second volume such that the one or more additional areas are adapted to hold a second portion of the mass of water wherein the second portion has a second mass of water. The water pump, during a cooling cycle, pumps the first mass of water from the recirculation area over the freeze plate wherein the first mass of water is cooled as it contacts the freeze plate and wherein some or all of the first mass of the water falls into the recirculation area of the sump.

Accordingly, as the portion of water in the recirculation area is recirculated, it can cool below 0° C. (32° F.) and subsequently turn all the recirculated water to slush as explained previously. At this point the water in the recirculation area, because it has been turned to slush, can no longer flow into the water pump. The water in the one or more additional areas, because it has not been cooled as much as the water in the recirculation area, is too warm to turn to slush and it will still flow. Accordingly, the portion of water in the one or more additional areas will flow to the water pump. As this warmer water is circulated, it quickly melts the water that had been turned to slush. This allows the ice making process to resume. Thus, with embodiments of the present invention, the "slush up" condition begins and ends in about 5 seconds, resulting in more efficient operation of the ice machine in a very simple manner with no additional moving or electronic parts.

BRIEF DESCRIPTION OF THE FIGURES

These and other features, aspects and advantages of the invention will become more fully apparent from the following detailed description, appended claims, and accompanying drawings, wherein the drawings illustrate features in accordance with exemplary embodiments of the present invention, and wherein:

FIG. 11 B is a right section view of a sump of an ice maker according to one embodiment of the present invention;

DETAILED DESCRIPTION

Before any embodiments of the invention are explained in detail, it will be understood that the invention is not limited in its application to the details of construction and the arrangement of components set forth in the following description or illustrated in the following drawings. The invention is capable of other embodiments and of being practiced or of being carried out in various ways. Also, it will be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Figure 1:
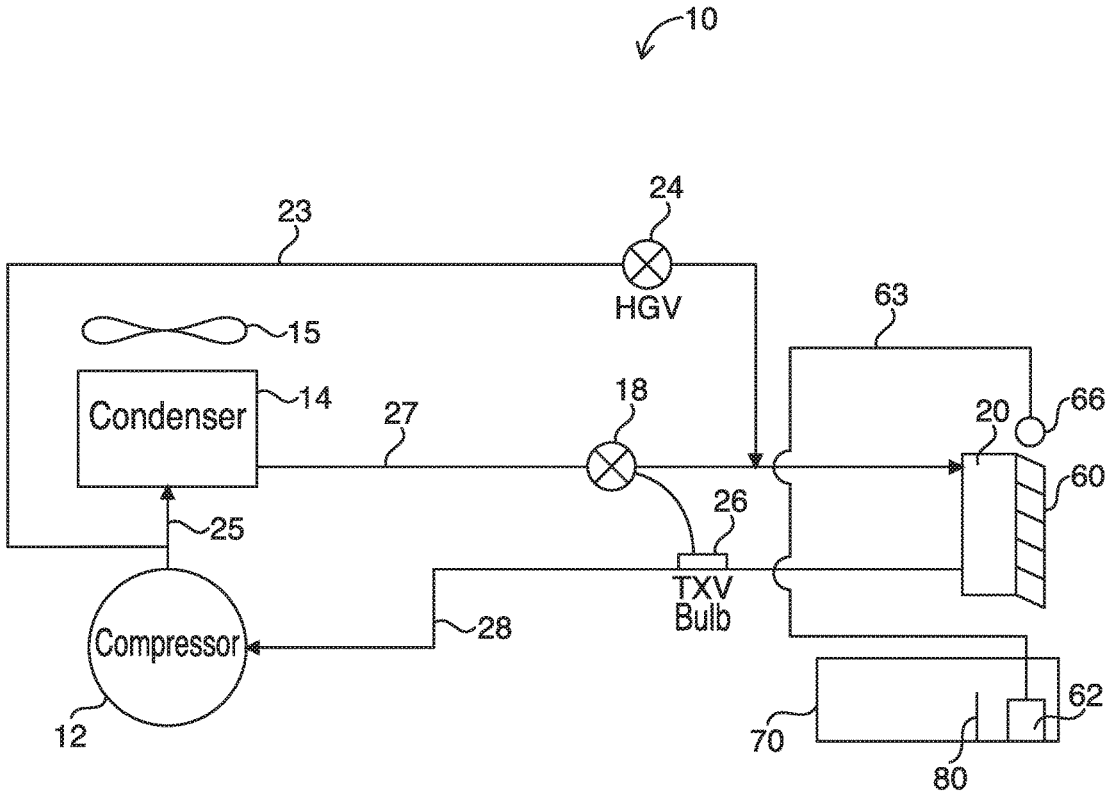
FIG. 1 is a schematic drawing of an ice maker having various components according to one embodiment of the present invention.
Figure 3:
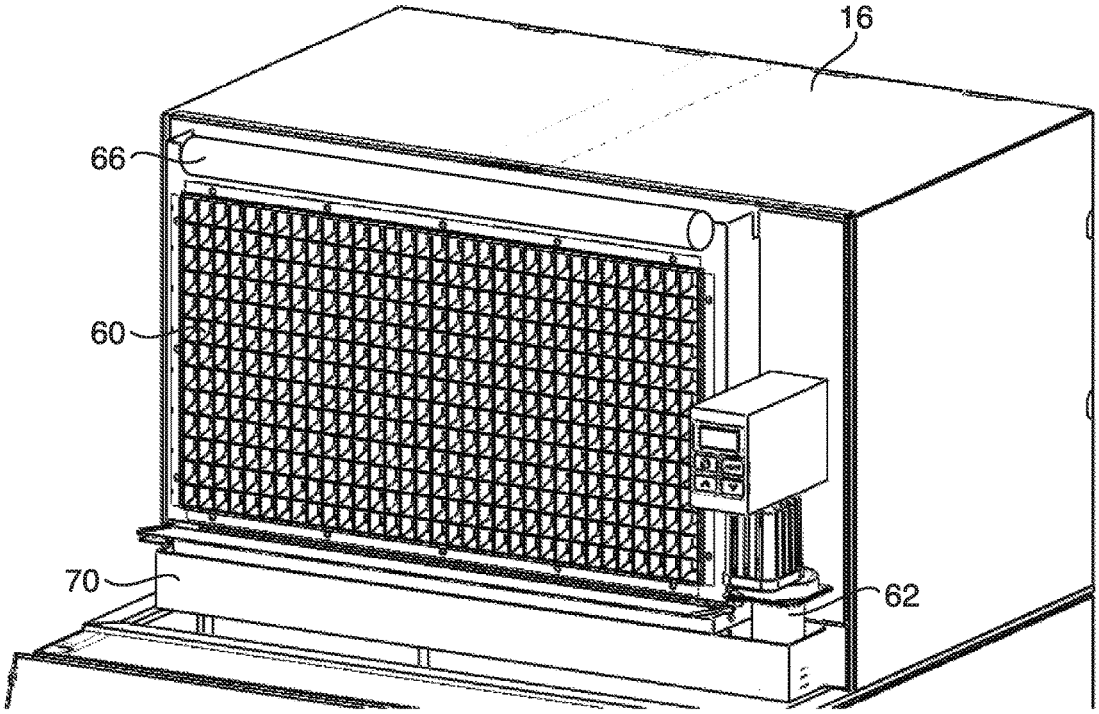
FIG. 3 is a left perspective view of a sump, freeze plate, water line and distribution tube or manifold of an ice maker according to one embodiment of the present invention.

FIG. 1 illustrates certain principal components of one embodiment of ice maker 10 having a refrigeration and ice making system. Ice maker 10 may include a compressor 12, a condenser 14 for condensing compressed refrigerant vapor discharged from the compressor 12, a thermal expansion device 18 for lowering the temperature and pressure of the refrigerant, and an evaporator assembly 20. In certain embodiments that utilize a gaseous cooling medium (e.g., air) to provide condenser cooling, a condenser fan 15 may be positioned to blow the gaseous cooling medium across condenser 14. The thermal expansion device 18 may include, but is not limited to, a capillary tube, a thermostatic expansion valve or an electronic expansion valve. Ice maker 10 also includes a freeze plate 60 thermally coupled to evaporator assembly 20. In certain embodiments, freeze plate 60 may contain a large number of pockets (usually in the form of a grid of cells) on its surface where water flowing over the surface can collect (see FIG. 3). As water is pumped from sump 70 by water pump 62 through water line 63 and out of distributor manifold or tube 66, the water impinges on freeze plate 60, flows over the pockets of freeze plate 60 and freezes into ice. Sump 70 may be positioned below freeze plate 60 to catch the water coming off of freeze plate 60 such that the water may be recirculated by water pump 62 (see FIG. 3). In certain embodiments, where thermal expansion device 18 is a thermostatic expansion valve or an electronic expansion valve, ice maker 10 may also include a temperature sensing bulb 26 placed at the outlet of the evaporator assembly 20 to control thermal expansion device 18. In addition, a hot gas valve 24 may be used to direct warm refrigerant from compressor 12 directly to evaporator assembly 20 to remove or harvest ice cubes from freeze plate 60 when the ice has reached the desired thickness. As described more fully elsewhere herein, a form of refrigerant cycles through these components via a lines 23, 25, 27, 28. Ice maker 10 may have other conventional components not described herein, including, but not limited to, a water supply, a controller, and a source of electrical energy.

Figure 2:
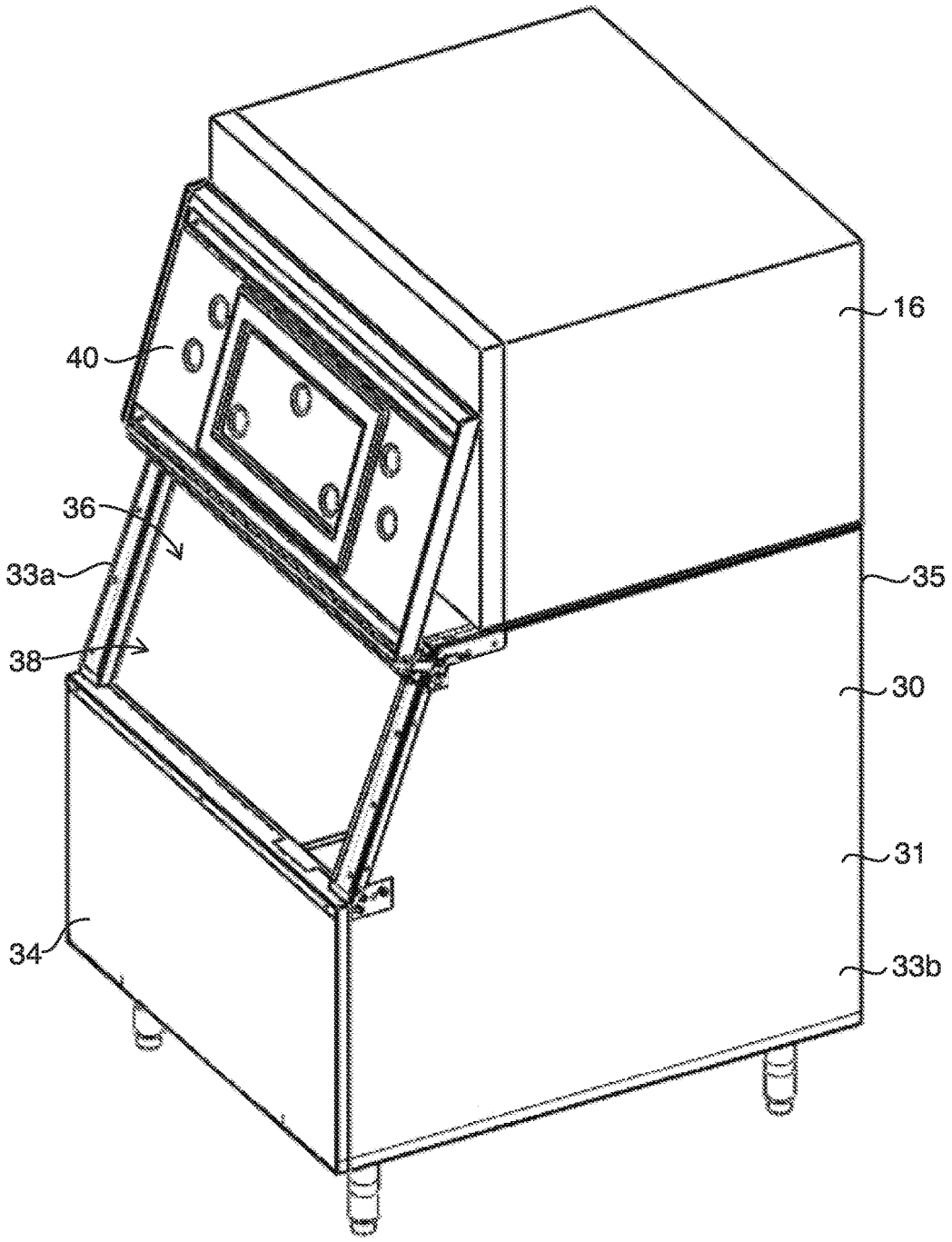
FIG. 2 is a right perspective view of an ice maker on an ice storage bin assembly having an upwardly swinging door with the door of the ice storage bin assembly in the open position according to one embodiment of the present invention.

In many embodiments, as illustrated in FIG. 2, ice maker 10 may be disposed inside of a cabinet 16 which may be mounted on top of an ice storage bin assembly 30. Ice storage bin assembly 30 includes an ice storage bin 31 having a cavity 36 in which ice produced by ice maker 10 falls into and is stored until retrieved. The ice storage bin 31 further includes an opening 38 which provides access to the cavity 36 and the ice stored therein. The cavity 36 and the opening 38 are formed by a left wall 33*a*, a right wall 33*b*, a front wall 34, a back wall 35 and a bottom wall (not shown). The walls of ice storage bin 31 may be thermally insulated with various insulating materials including, but not limited to, fiberglass insulation or open- or closed-cell foam comprised, for example, of polystyrene or polyurethane, etc. in order to retard the melting of the ice stored in ice storage bin 31. A door 40 can be opened to provide access to cavity 36.

Having described each of the individual components of one embodiment of ice maker 10, the manner in which the components interact and operate in various embodiments may now be described. During operation of ice maker 10 in a cooling cycle, comprising both a sensible cycle and a latent cycle, compressor 12 receives low-pressure, substantially gaseous refrigerant from evaporator assembly 20 through suction line 28, pressurizes the refrigerant, and discharges high-pressure, substantially gaseous refrigerant through discharge line 25 to condenser 14. In condenser 14, heat is removed from the refrigerant, causing the substantially gaseous refrigerant to condense into a substantially liquid refrigerant.

After exiting condenser 14, the high-pressure, substantially liquid refrigerant is routed through liquid line 27 to thermal expansion device 18, which reduces the pressure of the substantially liquid refrigerant for introduction into evaporator assembly 20. As the low-pressure expanded refrigerant is passed through tubing of evaporator assembly 20, the refrigerant absorbs heat from the tubes contained within evaporator assembly 20 and vaporizes as the refrigerant passes through the tubes. Low-pressure, substantially gaseous refrigerant is discharged from the outlet of evaporator assembly 20 through suction line 28, and is reintroduced into the inlet of compressor 12.

In certain embodiments of the present invention, at the start of the cooling cycle, comprising both the sensible cooling cycle and the latent cooling cycle, a water fill valve (not shown) is turned on to supply a mass of water to sump 70, wherein the ice maker will freeze some or all of the mass of water will be frozen into ice. Any embodiment of sump 70, as described more fully elsewhere herein, can be used in residential, commercial and industrial applications. Accordingly, sump 70 can hold any mass of water. Various embodiments of sump 70 can typically hold between less than 0.45 kilograms (1 pound) of water. In other embodiments, for example, sump 70 can hold about 0.45 kilograms (about 1 pound) or more of water. In other embodiments, for example, sump 70 can hold about 2.27 kilograms (about 5 pounds) or more of water. In yet other embodiments, for example, sump 70 can hold about 4.54 kilograms (about 10 pounds) or more of water. In yet other embodiments, for example, sump 70 can hold about 9.07 kilograms (about 20 pounds) or more of water. In yet other embodiments, for example, sump 70 can hold about 13.61 kilograms (about 30 pounds) or more of water. In yet other embodiments, for example, sump 70 can hold about 18.14 kilograms (about 40 pounds) or more of water. In yet other embodiments, for example, sump 70 can hold about 22.68 kilograms (about 50 pounds) or more of water. Accordingly, it will be understood that sump 70 may be adapted to hold any mass of water without departing from the scope of the present invention.

After the desired mass of water is supplied to sump 70, the water fill valve may be closed. Water pump 62 is then turned on to supply water to freeze plate 60 via water line 63 and distributor manifold or tube 66. Compressor 12 is turned on to begin the flow of refrigerant through the refrigeration system. The water that is supplied by water pump 62 then, during the sensible cooling cycle, begins to cool as it contacts freeze plate 60, returns to water sump 70 below freeze plate 60 and is recirculated by water pump 62 to freeze plate 60. Once the cooling cycle enters the latent cooling cycle, water flowing across freeze plate 60 starts forming ice cubes. After the ice cubes are formed, water pump 62 is turned off and hot gas valve 24 is opened allowing warm, high-pressure gas from compressor 12 to flow through hot gas bypass line 23 to enter evaporator assembly 20, thereby harvesting the ice by warming freeze plate 60 to melt the formed ice to a degree such that the ice may be released from freeze plate 60 and falls through a hole (not shown) into ice storage bin 31 (see FIG. 2) where the ice can be temporarily stored and later retrieved. Hot gas valve 24 is then closed and the cooling cycle can repeat.

As discussed above, in certain situations in prior art ice makers, the mass of water in prior art sumps can sub-cool before the water begins to freeze on freeze plate 60. When the water sub-cools, the water temperature falls below 0° C. (32° F.). In certain situations, the water temperature can drop to about −2.22° C. (about 28° F.). As a result of the water becoming sub-cooled it is not uncommon for some or all of the mass of water in the sump to begin to freeze or "slush up." A "slush-up" condition thus happens when the water that is being recirculated over the freeze plate sub-cools and then suddenly begins to freeze. Under certain conditions, a single ice crystal in the sub-cooled water can quickly propagate through all of the water in the sump, turning all of the sub-cooled water to slush. The water in the water line and distributor manifold or tube can also slush up. When this happens, the water cannot be pumped from the sump, through the water line and distributor manifold or tube, and across the freeze plate, thus terminating any water flow across freeze plate 60. Accordingly, the ice maker will stop refrigerating the water and ice production will cease. This "slush up"condition can last from about 30 seconds to several minutes, or even longer, until the water in the sump warms and the slush thaws back into liquid water. This "slush up"condition represents inefficiency in the cooling cycle because the water is not being cooled for a period of time. Additionally, the time required to produce ice is extended until the slush dissipates enough for the water to resume flowing through the ice making system.

In order to reduce, eliminate and/or avoid "slush up" conditions, certain embodiments of the present invention include a sump 70 that has multiple areas: (i) a recirculation area and (ii) one or more additional areas. The recirculation area and the one or more additional areas are in fluid communication via one or more passageways. As described above, sump 70 can hold a mass of water wherein some or all of the mass of water will be frozen into ice in the ice maker. Each of the multiple areas can hold portions of the mass of water that will be used to make ice. In a recirculation area of sump 70, water is continuously recirculated by water pump 62 over freeze plate 60 and into the recirculation area of sump 70. This acts to reduce the temperature of the water in the recirculation area and, as described more fully elsewhere herein, also acts to reduce the sensible energy of the water in the recirculation area. Because recirculation area is separate from the one or more additional areas, the water contained in the additional areas is not cooled as much as the water in the recirculation area. This causes the water contained in the additional areas to have a higher temperature than the water in the recirculation area and, as described more fully elsewhere herein, the water in the additional areas has a higher sensible energy than the water in the recirculation area. If and/or when a "slush up" condition occurs, the slush will be contained in the recirculation area and water pump 62 will tend to draw the warmer water from the additional areas of sump 70 through the one or more passageways after slush forms in the recirculation area. This warmer water, having a higher sensible energy, will tend to melt the slush near water pump 62 inlet and will also melt any slush in water lines 63 and distributor manifold or tube 66 as the warmer water is being circulated. This warmer water will then fall over freeze plate 60, cooling slightly, yet will remain warm enough to melt the slush on freeze plate 60 and in the recirculation area. Accordingly, to melt the slush in the recirculation area of sump 70, the amount of energy of the water in the recirculation area that causes slush has to be offset by the amount of energy of the water in the one or more additional areas. The "slush" energy of the water in the recirculation area ($Q_{slush}$) (i.e., the energy required to form slush) is equal to the mass of water in the recirculation area ($M_{recirc_area}$), multiplied by the difference between the freezing point of water and the temperature of the water in the recirculation area ($T_{recirc_area}$), further multiplied by the specific heat of water (c). This follows the below equation:

$$Q_{slush}=m_{recirc_area}\times(32^\circ\text{ F.}-T_{recirc_area})\times c.$$

The sensible energy of the water in the additional areas ($Q_{melt}$) to melt the slush in the recirculation area must be equal to or greater than the sensible energy of the water in the recirculation area ($Q_{melt}\geq Q_{slush}$). The "melt" energy of the water in the additional areas ($Q_{melt}$) is equal to the mass of water in the additional areas ($m_{add'l_areas}$), multiplied by the difference between the temperature of the water in the additional areas ($T_{add'l_areas}$) and the freezing point of water and, further multiplied by the specific heat of water (c). This follows the below equation:

$$Q_{melt}=m_{add'l_areas}\times(T_{add'l_areas}-32^\circ\text{ F.})\times c.$$

As an example, if 1 pound of water is in the recirculation area at a temperature of 28° F. then, the amount of energy for that 1 pound of water to form into slush would be about 4 Btus ($Q_{slush}$=1 lb.×(32° F.−28° F.)×1 Btu/lb-F=4 Btus). In order to melt that 1 pound of water in the recirculation area, the amount of energy of the water in the additional areas must be, at least, equal to and, preferably, greater than 4 Btu. Thus, if the water in the additional areas has a mass of 1 pound, then the temperature of the water in the additional areas has to be about 36° F. to melt the slush in the recirculation area ($Q_{melt}$=1lb.×(36° F.−32° F.)×1 Btu/lb-F=4 Btus).

To increase the sensible energy of the water in the additional areas, in certain embodiments, the volume of the one or more additional areas may be such that the one or more additional areas are adapted to hold a greater mass of water than the mass of the water in the recirculation area. In various embodiments, the total volume of the one or more additional areas may be about 1 to about 5 times the volume of the recirculation area. In one embodiment, for example, the total volume of the one or more additional areas may be about 1 times the volume of the recirculation area. In another embodiment, for example, the total volume of the one or more additional areas may be about 1.5 times the volume of the recirculation area. In yet another embodiment, for example, the total volume of the one or more additional areas may be about 2 times the volume of the recirculation area. In yet another embodiment, for example, the total volume of the one or more additional areas may be about 2.5 times the volume of the recirculation area. In yet another embodiment, for example, the total volume of the one or more additional areas may be about 3 times the volume of the recirculation area. In yet another embodiment, for example, the total volume of the one or more additional areas may be about 3.5 times the volume of the recirculation area. In yet another embodiment, for example, the total volume of the one or more additional areas may be about 4 times the volume of the recirculation area. In yet another embodiment, for example, the total volume of the one or more additional areas may be about 4.5 times the volume of the recirculation area. In yet another embodiment, for example, the total volume of the one or more additional areas may be about 5 times the volume of the recirculation area. In certain embodiments, for example, 2 pounds of water can be in the additional areas and 1 pound of water can be in the recirculation area. In other embodiments, additionally or alternatively, the temperature of the water in the additional areas may be raised to or maintained at a higher temperature so that the temperature difference between the temperature of water in the one or more additional areas and the freezing point of water is greater than the temperature difference between the freezing point of water and the temperature of the water in the recirculation area. In certain embodiments, for example, the temperature of the water in the additional areas can be raised to or maintained at 38° F. In various embodiments, for example where the temperature of the water in the additional areas may be raised to or maintained at a higher temperature, the volume of the one or more additional areas may be such that the one or more additional areas are adapted to hold a lesser mass of water than the mass of the water in the recirculation area. In one embodiment, for example, the total volume of the one or more additional areas may be 1 times or less than the volume of the recirculation area. In another embodiment, for example, the total volume of the one or more additional areas may be 0.75 times or less than the volume of the recirculation area. In yet another embodiment, for example, the total volume of the one or more additional areas may be 0.5 times or less than the volume of the recirculation area. In yet another embodiment, for example, the total volume of the one or more additional areas may be 0.25 times or less than the volume of the recirculation area.

Figure 4A:
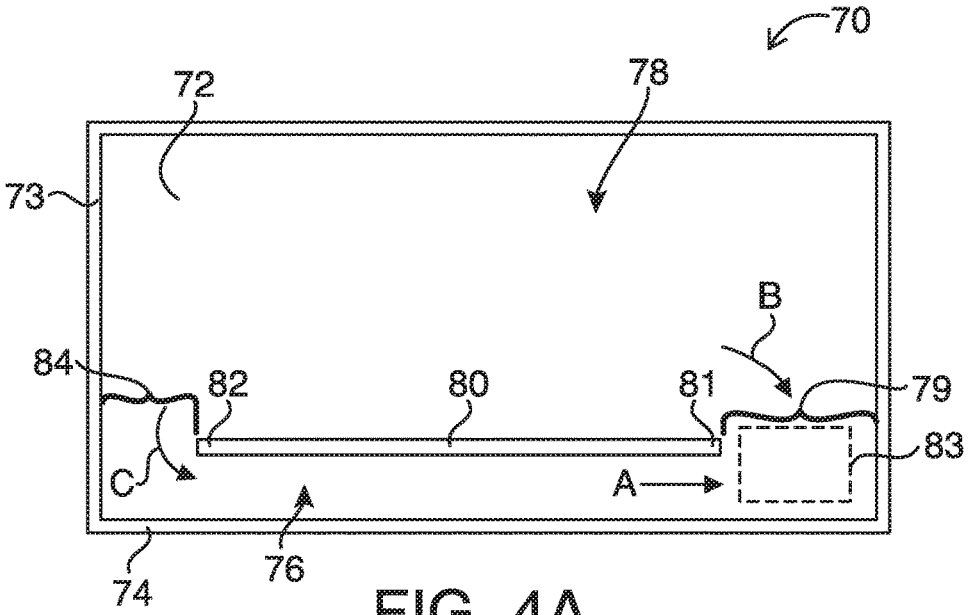
FIG. 4A is a top view of a sump of an ice maker according to one embodiment of the present invention.
Figure 4B:
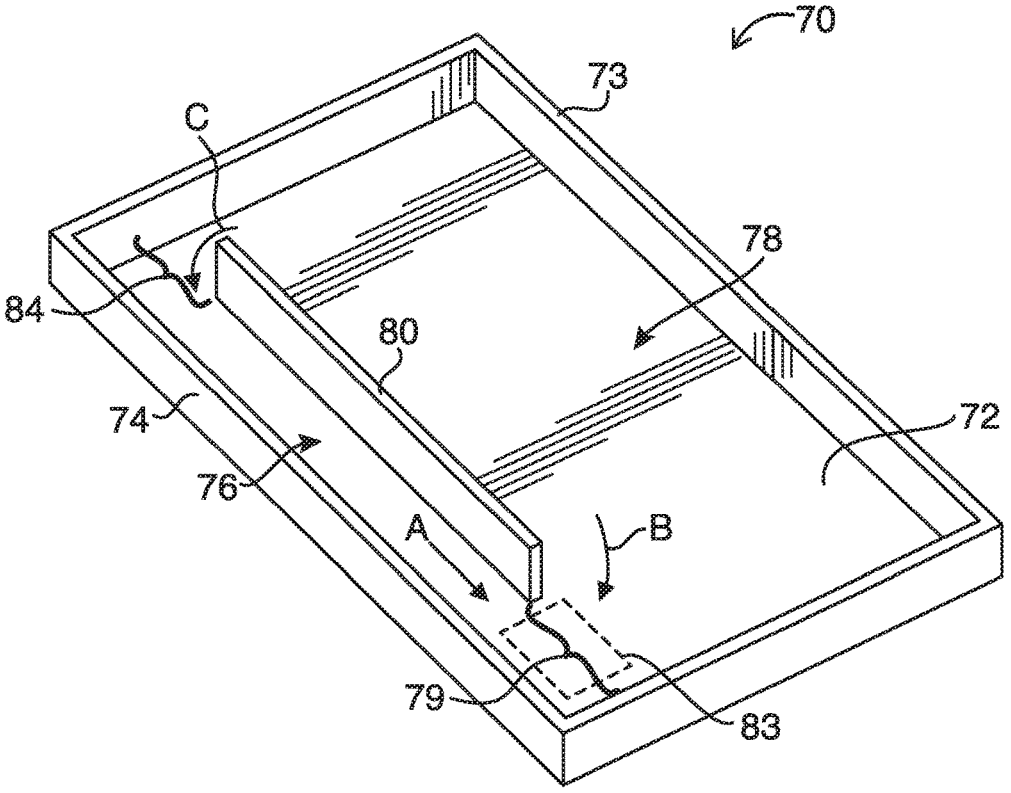
FIG. 4B is a right perspective view of a sump of an ice maker according to one embodiment of the present invention.

An improved sump which can reduce, eliminate and/or avoid a "slush up"conditions according to one embodiment of the present invention is illustrated in detail in FIGS. 4A and 4B. In one particular embodiment, sump 70 comprises a bottom 72 and a wall 73 extending therefrom such that sump 70 can hold water. Sump 70 has, within wall 73, a recirculation area 76 and an additional area 78 which are substantially, but not completely, separated by baffle 80 such that recirculation area 76 and additional area 78 may be in fluid communication via first passageway 79. Baffle 80 may have a proximal end 81 and a distal end 82 wherein proximal end 81 terminates a distance away from wall 73, thus providing for first passageway 79. Accordingly, proximal end 81 may be disposed near area of sump 70 bounded by box 83. In certain embodiments, distal end 82 may terminate at or be connected to wall 73. In other embodiments distal end 82 may terminate a distance away from wall 73. In one particular embodiment, baffle 80 is disposed parallel to a front portion 74 of wall 73. Baffle 80 may be located or oriented such that the volume of additional area 78 may be greater than the volume of recirculation area 76 such that additional area 78 may be adapted to hold a greater portion of the mass of water than the portion of mass of water in recirculation area 76 (i.e., the mass of water in additional area 78 may be greater than the mass of water in recirculation area 76). As previously described, in various embodiments, the volume of additional area 78 may be about 1 to about 5 times the volume of recirculation area 76. This can aid in keeping the sensible energy of the water in additional area 78 higher than the sensible energy of the water in recirculation area 76. Additionally, baffle 80 may be located a distance from front portion 74 of wall 73 such that the water that is supplied by water pump 62 to freeze plate 60 and that which returns to water sump 70 substantially collects in recirculation area 76 where it is substantially separated by baffle 80 from the water that is in additional area 78 which is not being recirculated by water pump 62. Water pump 62 and/or an inlet to water pump 62 may be located in area of sump 70 bounded by box 83 and may be disposed such that water pump 62 primarily draws and recirculates water from recirculation area 76 as illustrated by arrow A. The water in recirculation area 76 tends to be colder than the water in additional area 78, because the water in recirculation area 76 is being recirculated over freeze plate 60 while the water in additional area 78 is primarily not recirculated over the freeze plate 60. Accordingly, the sensible energy of the water in additional area 78 may be higher than the sensible energy of the water in recirculation area 76. Because the water that is being recirculated (from recirculation area 76) gets slightly colder than the water is not being recirculated (from additional area 78), the recirculated water in recirculation area 76 may still slush whereas the non-recirculated water in additional area 78 will not slush.

Baffle 80 assists in preventing or reducing the water in recirculation area 76 from mixing with the water in additional area 78, which thus assists in preventing or reducing the water in additional area 78 from becoming sub-cooled or forming into slush. If and/or when the recirculated water in recirculation area 76 freezes into slush, water pump 62 can draw the warmer water from additional area 78 through first passageway 79 as illustrated by arrow B. While slush held in recirculation area 76 may still be drawn toward water pump 62 (as illustrated by arrow A), the water pump will primarily draw the warmer water from additional area 78 through first passageway 79 (as illustrated by arrow B). As a result, water pump 62 tends not to clog, and the recirculation of water can continue permitting the continued making of ice. The slush that forms in recirculation area 76 will be warmed as the warmer water from additional area 78 mixes with the slush near water pump 62. Water pump 62 will then pump the warmer water from additional area 78 through water line 63 and distributor manifold or tube 66, melting any slush that formed therein. The warmer water from additional area 78 will then flow over freeze plate 60; cooling slightly. The slightly cooled warmer water will then fall into sump 70 in recirculation area 76 where it will melt the slush that formed therein.

In certain embodiments, for example, all of the slush can be melted in about 5 seconds or less. In other embodiments, for example, all of the slush can be melted in about 10 seconds or less. In yet other embodiments, for example, all of the slush can be melted in about 15 seconds or less. Consequently, unlike in prior art systems, separating the water that is being recirculated from water that is not being recirculated in sump 70 can permit the reduction, elimination and/or avoidance of a "slush up"condition and the production of ice can continue with little or no delay, without clogging water pump 62, and/or without requiring that water pump 62 be stopped while waiting for the slush to melt.

Figure 5A:
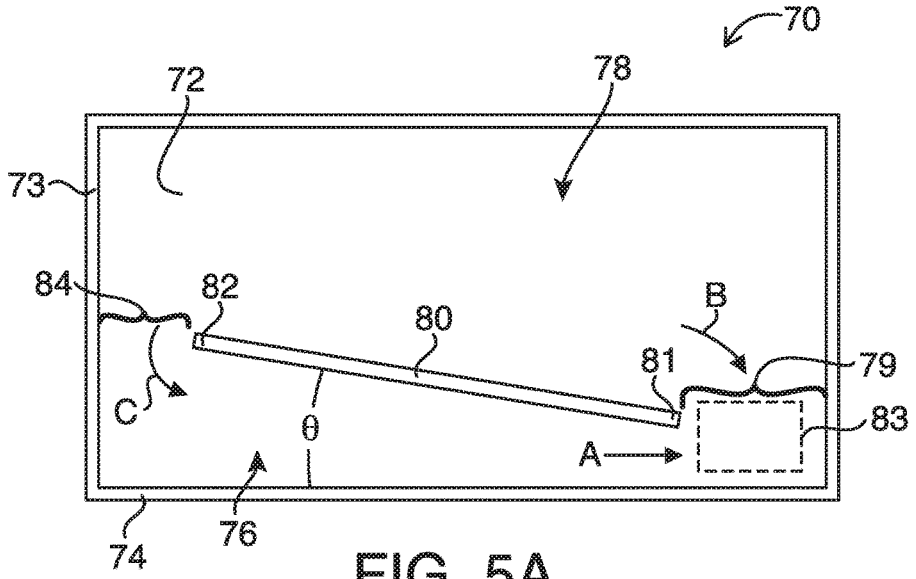
FIG. 5A is a top view of a sump of an ice maker according to one embodiment of the present invention.
Figure 5B:
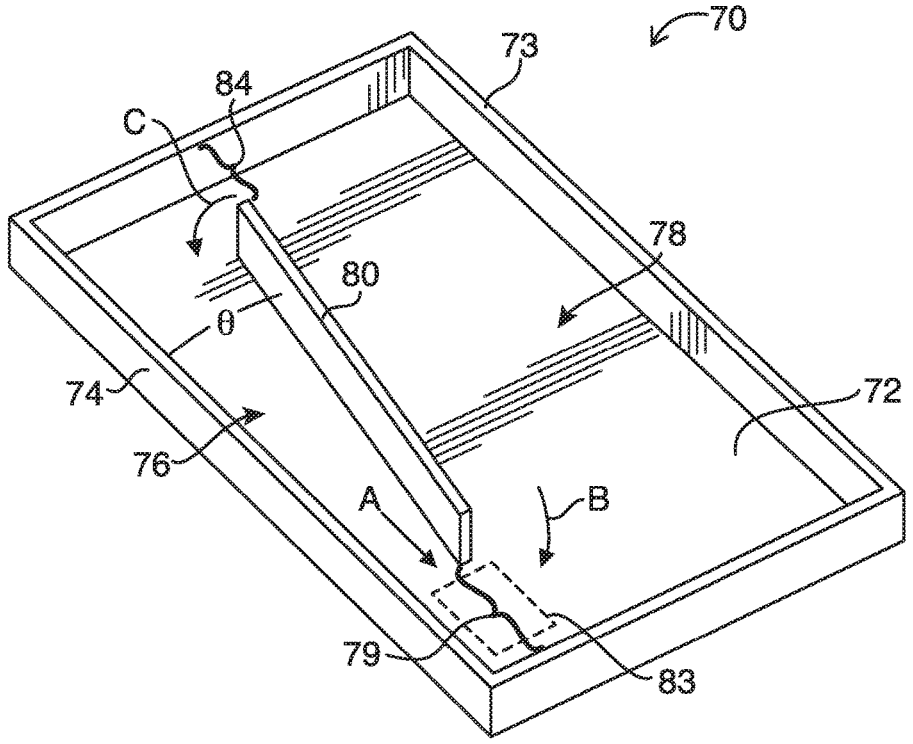
FIG. 5B is a right perspective view of a sump of an ice maker according to one embodiment of the present invention.
Figure 6A:
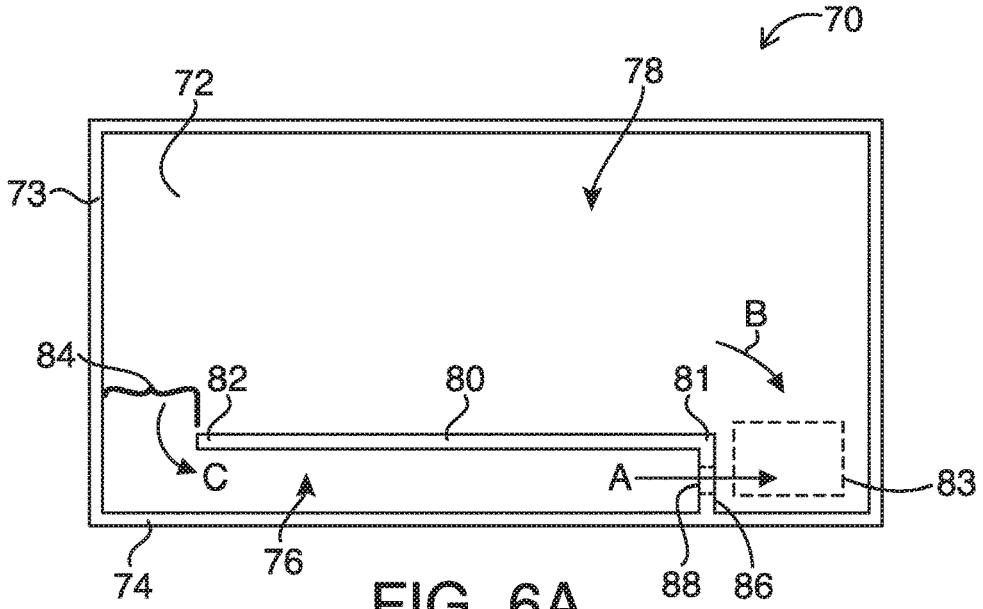
FIG. 6A is a top view of a sump of an ice maker according to one embodiment of the present invention.
Figure 6B:
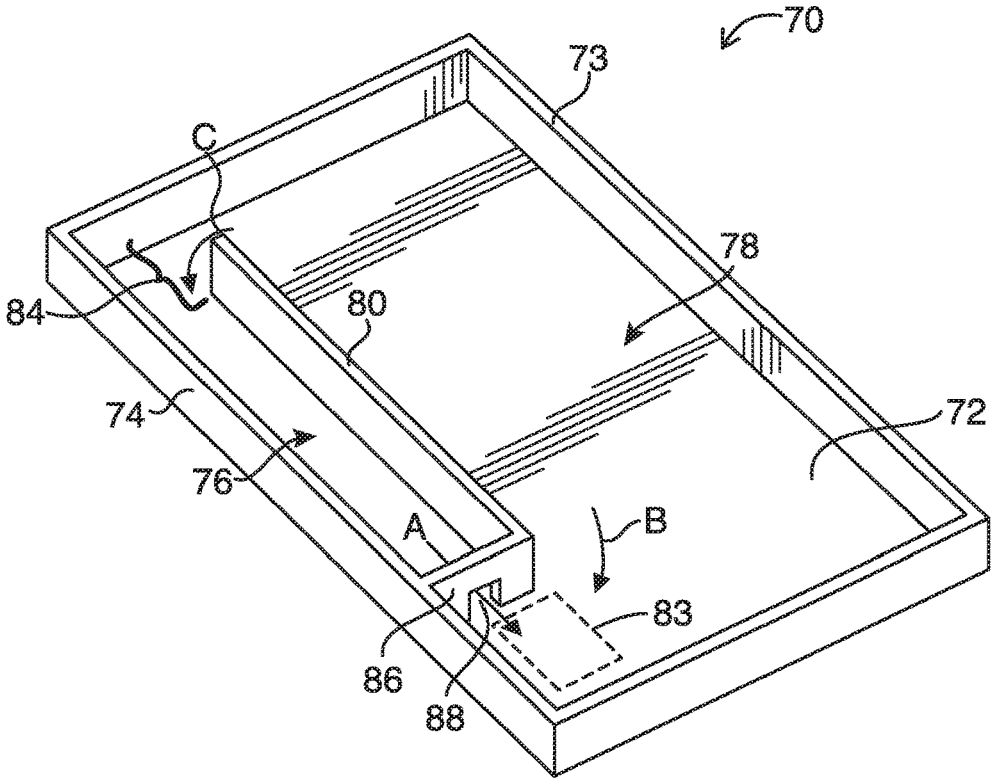
FIG. 6B is a right perspective view of a sump of an ice maker according to one embodiment of the present invention.
Figure 7A:
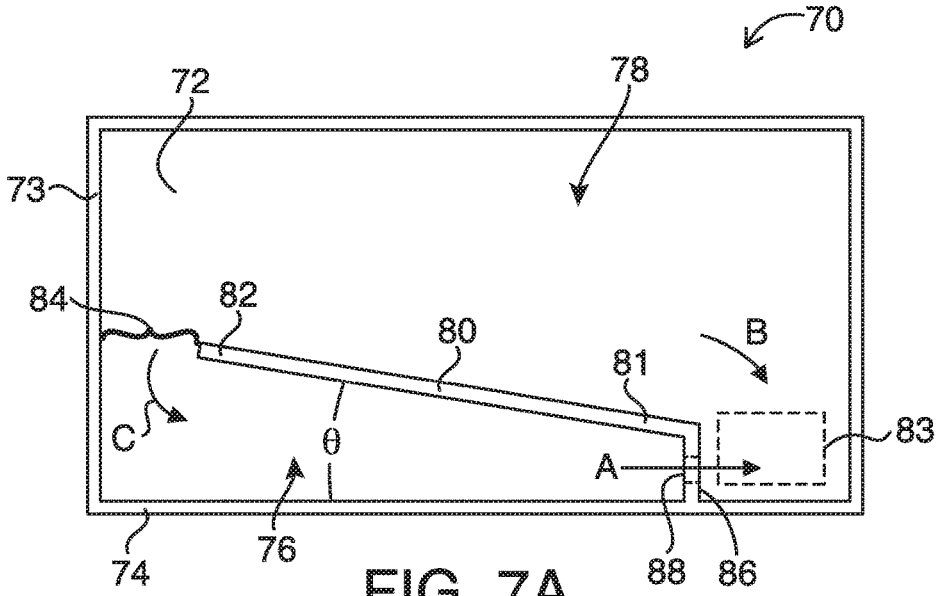
FIG. 7A is a top view of a sump of an ice maker according to one embodiment of the present invention.
Figure 7B:
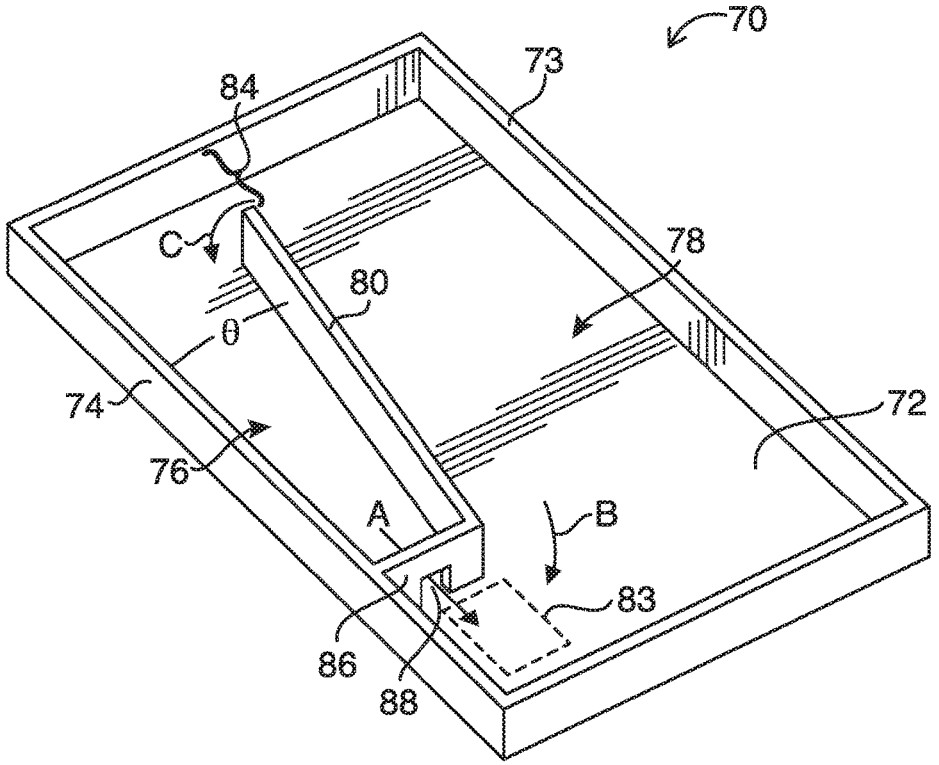
FIG. 7B is a right perspective view of a sump of an ice maker according to one embodiment of the present invention.

Referring now to FIGS. 5A and 5B, another embodiment of sump 70 is described in detail. In this particular embodiment, baffle 80 can be disposed at angle Θwith respect to front portion 74 of wall 73. By disposing baffle 80 at an angle, baffle 80 may assist in trapping or holding any slush that may form in recirculation area 76 away from water pump 62 thus reducing the possibility that water pump 62 will be clogged by slush. In yet another embodiment, for example, as illustrated by FIGS. 6A and 6B, baffle 80 may be connected to wall 73 by wall 86. Slush tends to float in the water in recirculation area 76. Thus, wall 86 may include one or more passageways 88 disposed at or near the bottom of wall 86 which permit the water in recirculation area 76 to be drawn into pump, as illustrated by arrow A, while wall 86 may assist in trapping or holding any slush that may form in recirculation area 76 away from water pump 62 thus reducing the possibility that water pump 62 will be clogged by slush. In yet another embodiment, for example, as illustrated in FIGS. 7A and 7B, baffle 80 may be disposed at an angle Θ with respect to wall 73 and baffle 80 may be connected to wall 73 by wall 86. Again, slush tends to float in the water in recirculation area 76. Thus, wall 86 may include one or more passageways 88 disposed at or near the bottom of wall 86 which permit the water in recirculation area 76 to be drawn into pump while wall 73 may assist in trapping or holding any slush that may form in recirculation area 76 away from water pump 62 thus reducing the possibility that water pump 62 will be clogged by slush. It will be understood that the one or more passageways 88 of any embodiment may be any shape including, but not limited to, rectangular, square, circular, semi-circular, ovular, etc. without departing from the scope of the present invention.

Figure 8:
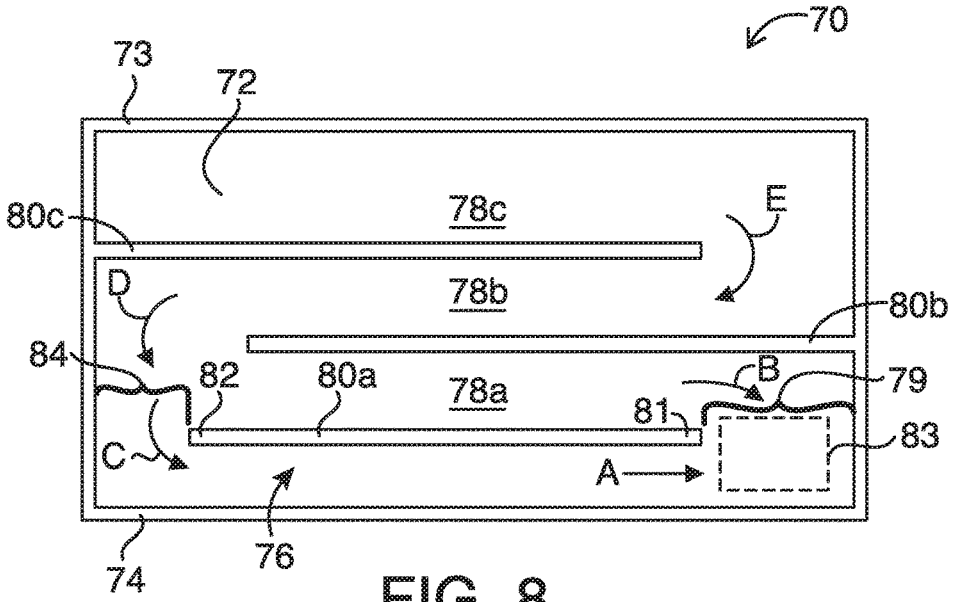
FIG. 8 is a top view of a sump of an ice maker according to one embodiment of the present invention.

Turning now to FIG. 8, in other embodiments, sump 70 may have more than one baffle which separates recirculation area 76 from the one or more additional areas 78*a*, 78*b*, 78*c*. In this particular embodiment, baffle 80*a* is disposed to separate recirculation area 76 from additional area 78*a*. Additional baffles 80*b*, 80*c* may further subdivide additional area 79*a*, 79*b*, 79*c*. Baffle 80*a* may be located or oriented such that the total volume of additional areas 78*a*, 78*b*, 78*c* may be greater than the volume of recirculation area 76 such that additional areas 78*a*, 78*b*, 78*c*, as whole, may be adapted to hold a greater portion of the mass of water than the portion of mass of water in recirculation area 76 (i.e., the mass of water in additional areas 78*a*, 78*b*, 78*c*, as whole, may be greater than the mass of water in recirculation area 76). As previously described, in various embodiments, the total volume of additional areas 78*a*, 78*b*, 78*c* may be about 1 to about 5 times the volume of recirculation area 76. This can aid in keeping the sensible energy of the water in additional areas 78*a*, 78*b*, 78*c* higher than the sensible energy of the water in recirculation area 76. Baffle 80*a* may be located a distance from front portion 74 of wall 73 such that the water that is supplied by water pump 62 to freeze plate 60 and that which returns to water sump 70 substantially collects in recirculation area 76 where it is substantially separated by baffle 80*a* from the water that is in additional areas 78*a*, 78*b*, 78*c* which is not being recirculated by water pump 62. Water pump 62 and/or an inlet to water pump 62 may be located in area of sump 70 bounded by box 83 and may be disposed such that water pump 62 primarily draws and recirculates water from recirculation area 76 as illustrated by arrow A. The water in recirculation area 76 tends to be colder than the water in additional areas 78*a*, 78*b*, 78*c*, because the water in recirculation area 76 is being recirculated over freeze plate 60 while the water in additional areas 78*a*, 78*b*, 78*c* is primarily not recirculated over the freeze plate 60. Accordingly, the sensible energy of the water in additional areas 78*a*, 78*b*, 78*c* may be higher than the sensible energy of the water in recirculation area 76. The inclusion of baffles 80*b*, 80*c* may further assist in keeping the sensible energy of the water in additional areas 79*a*, 79*b*, 79*c* higher than the sensible energy of the water in recirculation area 76. Furthermore, baffles 80*b*, 80*c* may further assist in keeping the sensible energy of water in additional area 79*c* higher than that of additional area 79*b*, which may be higher than that of additional area 79*a*. Because the water that is being recirculated (from recirculation area 76) gets slightly colder than the water is not being recirculated (from additional areas 78*a*, 78*b*, 78*c*), the recirculated water in recirculation area 76 may still slush whereas the non-recirculated water in additional areas 78*a*, 78*b*, 78*c* may tend not to slush.

Baffles 80*a*, 80*b*, 80*c* assist in preventing or reducing the water in recirculation area 76 from mixing with the water in additional areas 78*a*, 78*b*, 78*c*, which thus assists in preventing or reducing the water in additional areas 78*a*, 78*b*, 78*c* from becoming sub-cooled and freezing into slush. If and/or when the recirculated water in recirculation area 76 freezes into slush, water pump 62 can draw the warmer water from additional area 78*a* through first passageway 79 as illustrated by arrow B. Additionally, the orientation of baffles 80*b*, 80*c* permit water pump 62 to draw the warmer water from additional areas 78*b*, 78*c* as illustrated by arrows D and E. While slush held in recirculation area 76 may still be drawn toward water pump 62 (as illustrated by arrow A), the water pump will primarily draw the warmer water from additional area 78*a* through first passageway 79 (as illustrated by arrow B). As a result, water pump 62 tends not to clog, and the recirculation of water can continue permitting the continued making of ice. The slush that forms in recirculation area 76 will be warmed as the warmer water from additional areas 78*a*, 78*b*, 78*c* mixes with the slush near water pump 62. Water pump 62 will then pump the warmer water from additional areas 78*a*, 78*b*, 78*c* through water line 63 and distributor manifold or tube 66, melting any slush that formed therein. The warmer water from additional areas 78*a*, 78*b*, 78*c* will then flow over freeze plate 60; cooling slightly. The slightly cooled warmer water will then fall into sump 70 in recirculation area 76 where it will melt the slush that formed therein.

Figure 13:
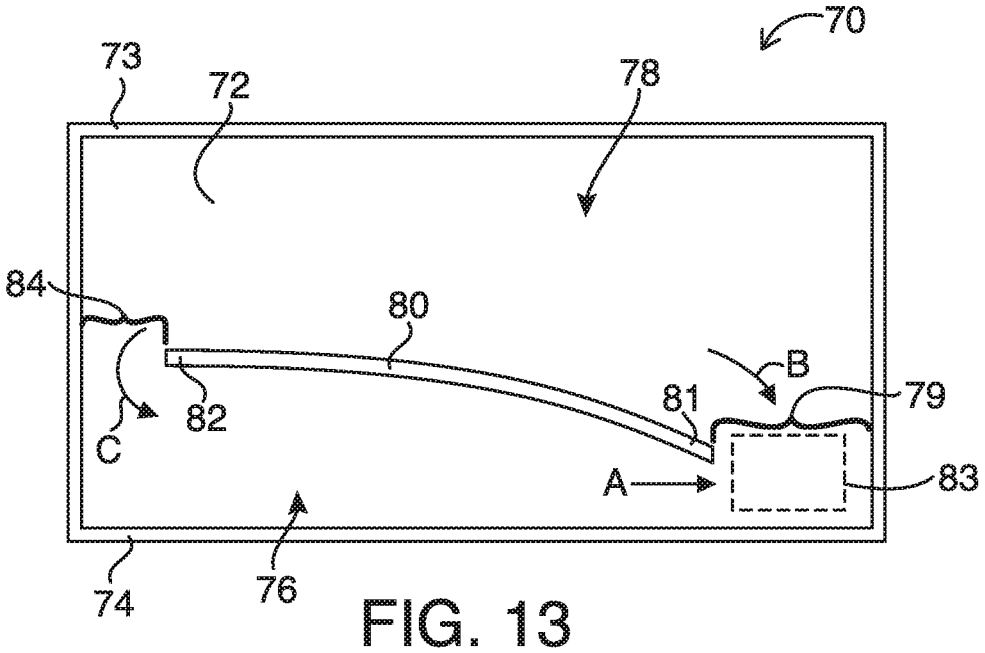
FIG. 13 is a top view of a sump of an ice maker according to one embodiment of the present invention.
Figure 14A:
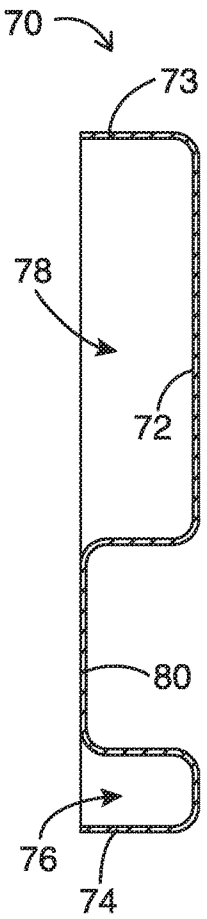
FIG. 14A is a right section view of a sump of an ice maker according to one embodiment of the present invention.
Figure 14:
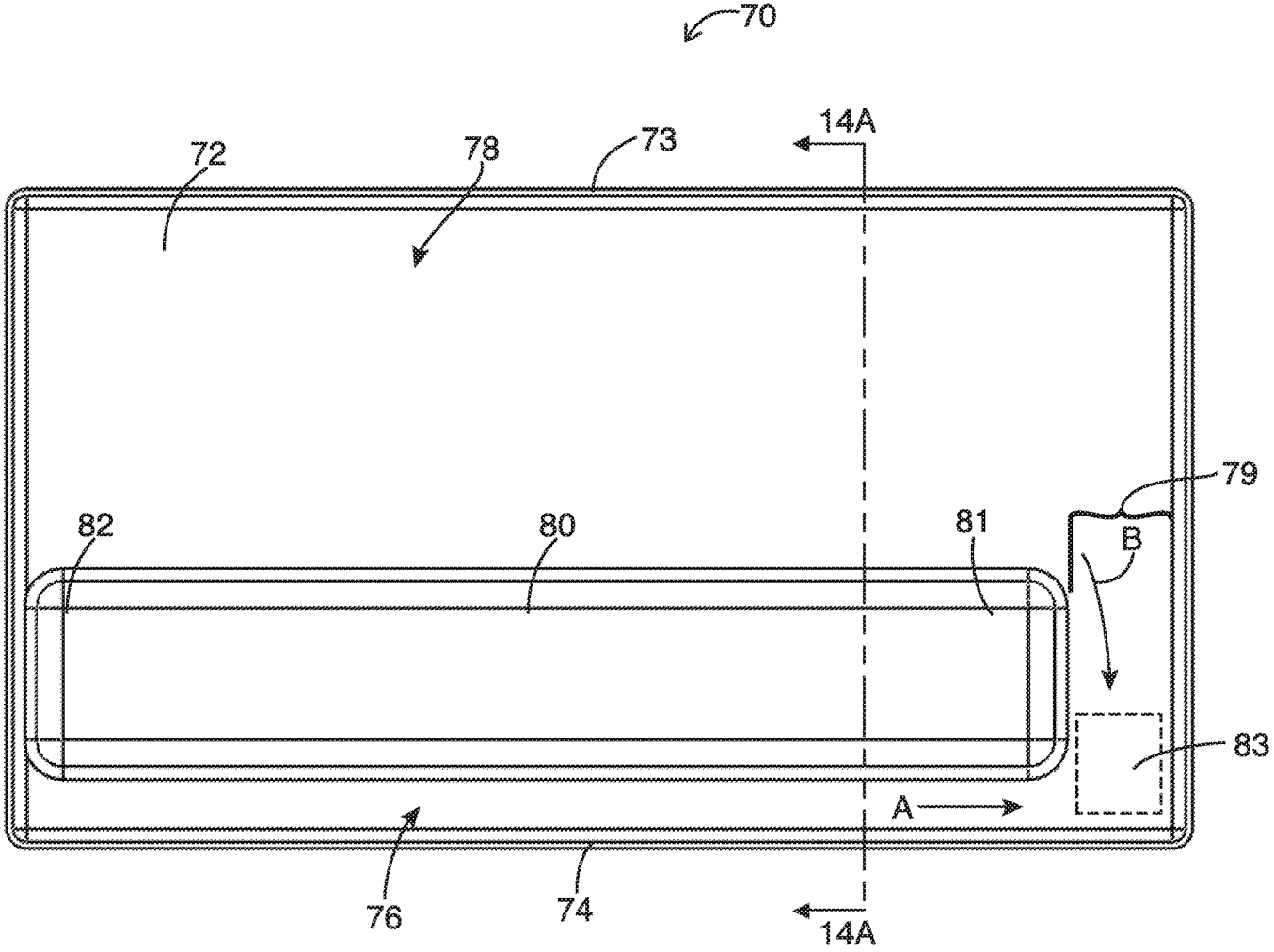
FIG. 14 is a top view of a sump of an ice maker according to one embodiment of the present invention.
Figure 14B:
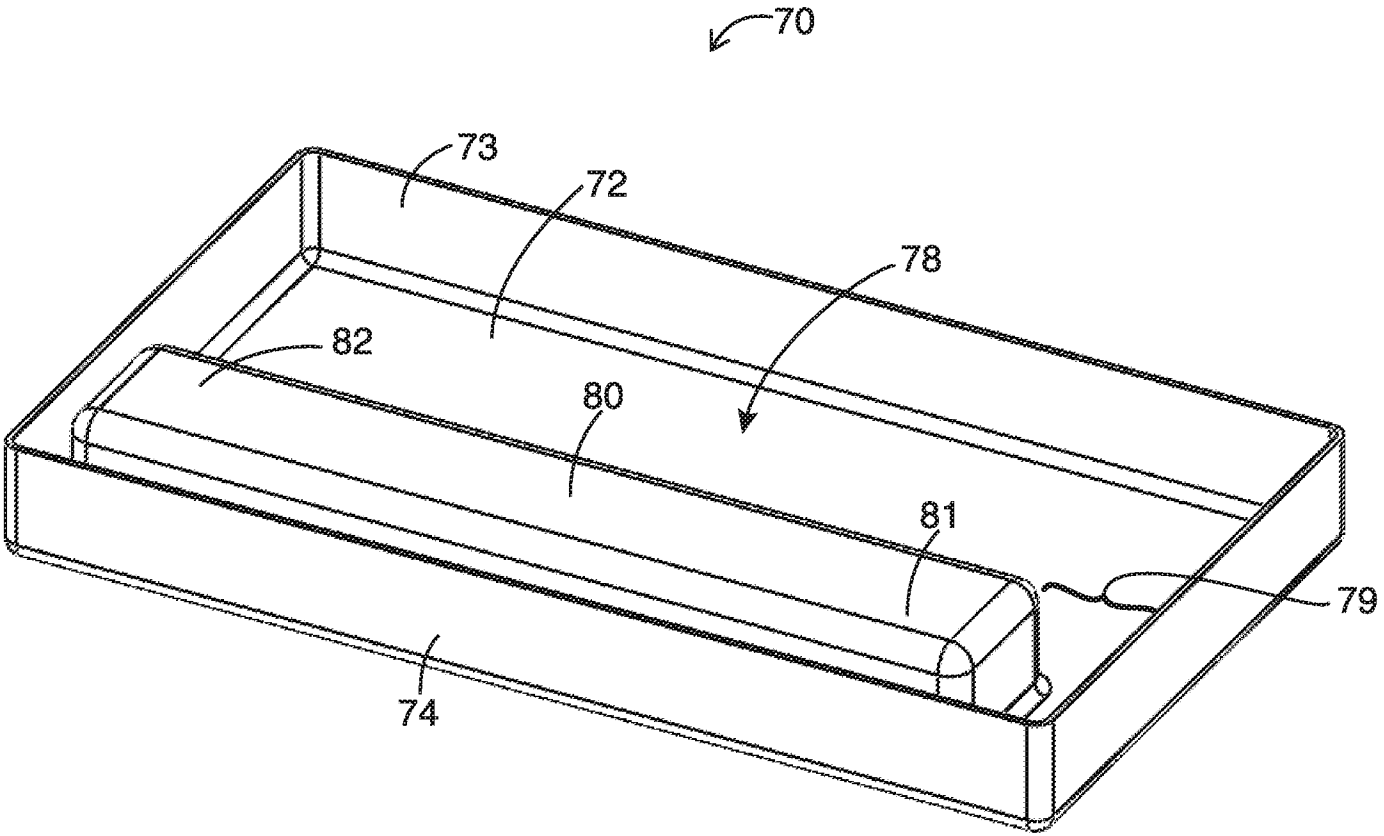
FIG. 14B is a right perspective view of a sump of an ice maker according to one embodiment of the present invention.

It will be further understood that baffle 80 is not required to be a straight baffle. Accordingly, as illustrated in FIG. 13, in one embodiment, for example, baffle 80 may be curved. Baffle 80 has been illustrated in the shape of a thin wall, however, it will be understood that baffle 80 may have any shape which acts to separate the recirculation area from the one or more additional areas without departing from the scope of the present invention. For example, in certain embodiments, as illustrated in FIGS. 14 and 14A, baffle 80 may comprise a wider wall. In certain embodiments, baffle 80 may be integrally formed into sump 70. In other embodiments, baffle 80 may be attached to sump 70 in a in a variety of ways, including, but not limited to, screws, rivets, adhesives, welds, brazing, etc. In yet other embodiments, baffle 80 may be removably attached to sump 70.

Figure 9:
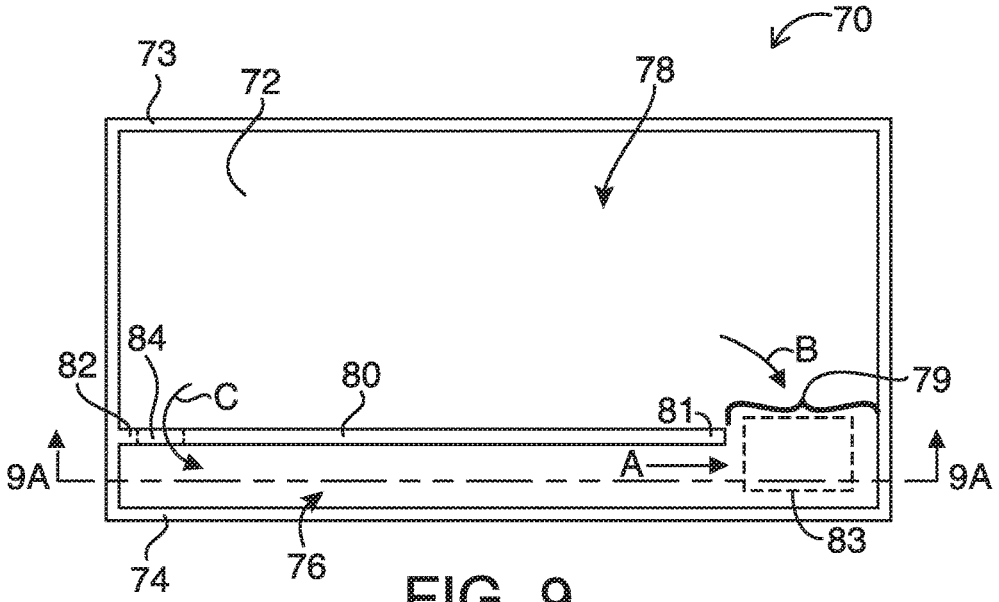
FIG. 9 is a top view of a sump of an ice maker according to one embodiment of the present invention.
Figure 9A:
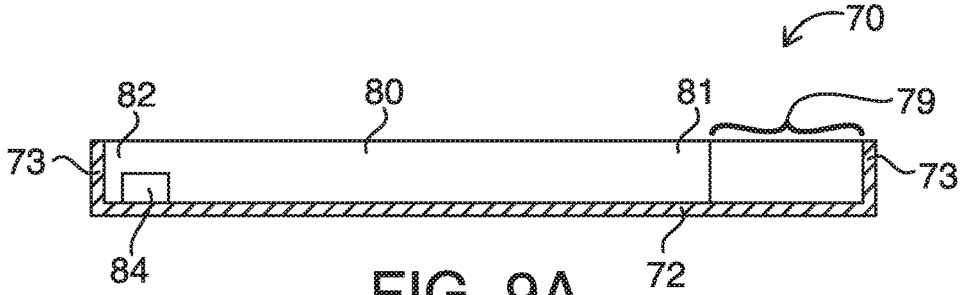
FIG. 9A is a front section view of a sump of an ice maker according to one embodiment of the present invention.
Figure 10:
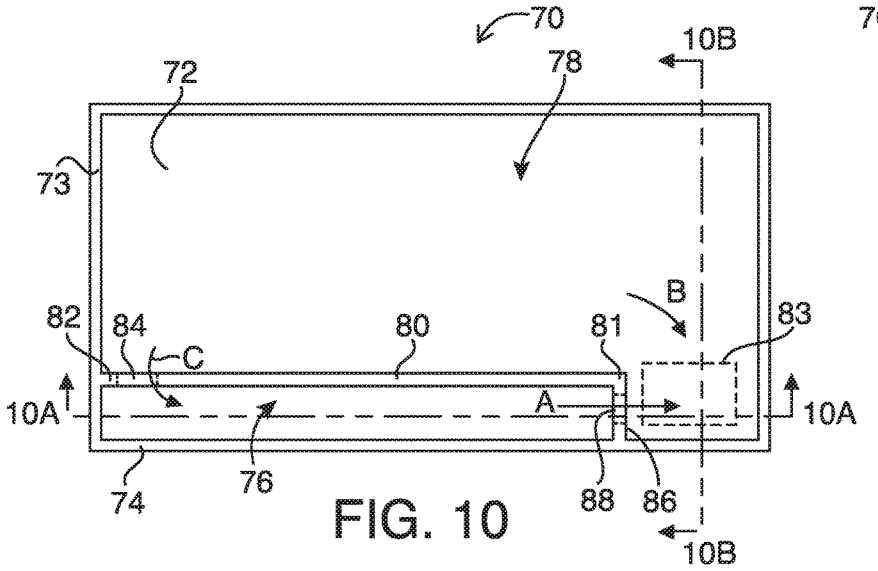
FIG. 10 is a top view of a sump of an ice maker according to one embodiment of the present invention.
Figure 10B:
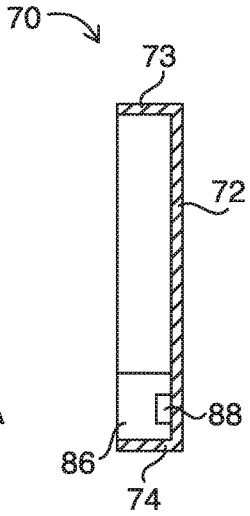
FIG. 10B is a right section view of a sump of an ice maker according to one embodiment of the present invention.
Figure 10A:
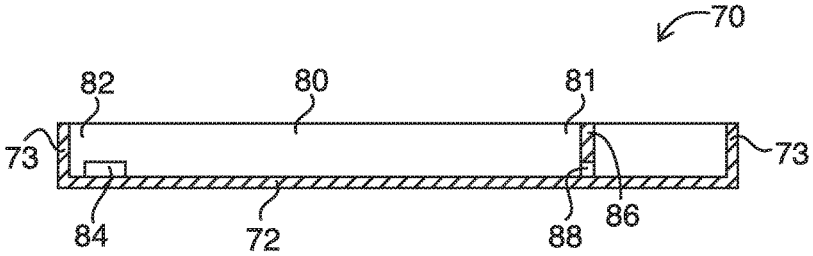
FIG. 10A is a front section view of a sump of an ice maker according to one embodiment of the present invention.
Figure 11:
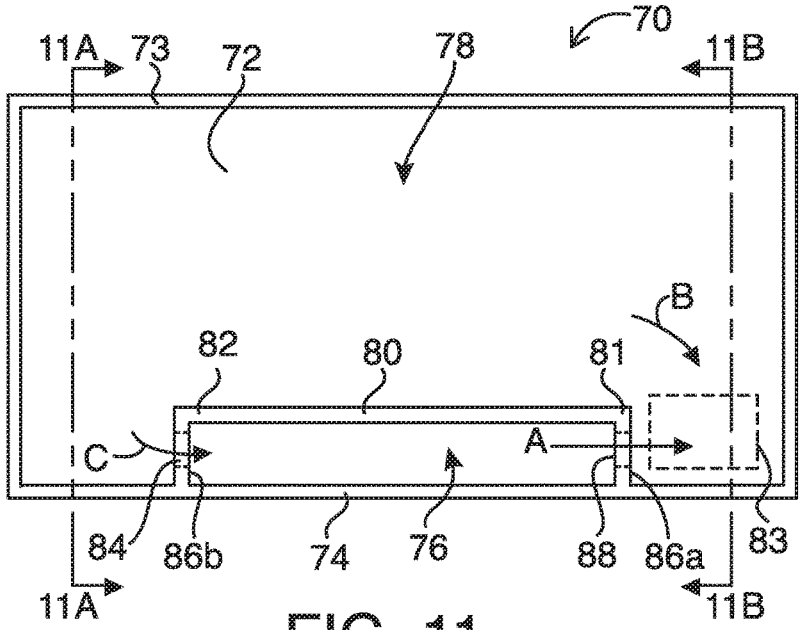
FIG. 11 is a top view of a sump of an ice maker according to one embodiment of the present invention.
Figure 11A:
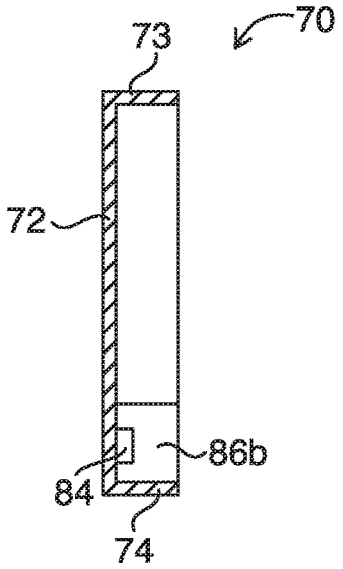
FIG. 11A is a left section view of a sump of an ice maker according to one embodiment of the present invention.
Figure 11B:
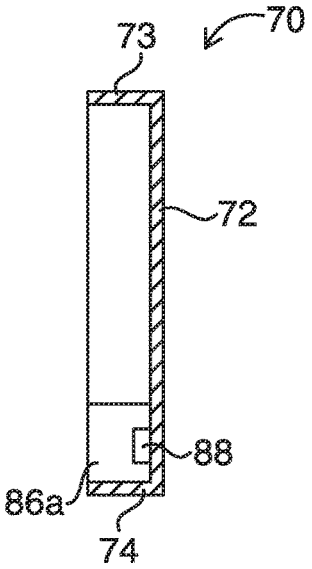

In certain embodiments, one or more passageways 84 may be between wall 73 and baffle 80. As illustrated in FIGS. 4A, 4B, 5A, 5B, 6A, 6B, 7A, 7B, 8, and 13, in some embodiments, distal end 82 of baffle 80 may terminate at a distance from wall 73, thus a second passageway 84 is formed by the gap between distal end 82 of baffle 80 and wall 73. As illustrated in FIGS. 9 and 9A, in other embodiments, for example, distal end 82 of baffle 80 may terminate at or be connected to wall 73 and one or more second passageways 84 may be disposed in baffle 80 at or near distal end 82 of baffle 80. Turning now to FIGS. 10, 10A, and 10B, in yet other embodiments, proximal end 81 of baffle 80 may be connected to wall 73 by wall 86 and distal end 82 of baffle 80 may terminate at or be connected to wall 73. One or more second passageways 84 may be disposed in baffle 80 at or near distal end 82 of baffle 80. Wall 86 may also include one or more passageways 88 disposed at or near the bottom of wall 86. In yet other embodiments, for example, as illustrated in FIGS. 11, 11A and 11B, proximal end 81 of baffle 80 may be connected to wall 73 by wall 86*a* and distal end 82 of baffle 80 may be connected to wall 73 by wall 86*b*. One or more second passageways 84 may be disposed in wall 86*b*. If and/or when slush forms, the slush tends to float in the water in recirculation area 76. Thus, in various embodiments, walls 86, 86*a* may include one or more passageways 88 disposed at or near the bottom of walls 86, 86*a* which permit the water in recirculation area 76 to be drawn into pump while walls 86, 86*a* may assist in trapping or holding any slush that may form in recirculation area 76 away from water pump 62 thus reducing the possibility that water pump 62 will be clogged by slush. In various embodiments, the one or more first passageways 79 and second passageways 84 may be any shape including, but not limited to, rectangular, square, circular, semi-circular, ovular, etc. without departing from the scope of the present invention. Additionally, the one or more passageways 88 of any embodiment may be any shape including, but not limited to, rectangular, square, circular, semi-circular, ovular, etc. If and/or when slush forms in recirculation area 76, any water that is not frozen into slush in recirculation area 76 will be drawn toward pump 62 and out of recirculation area 76 as illustrated by arrow A. Second passageways 84 permit a flow of warmer water from additional area 78 into recirculation area 76 as illustrated by arrow C. The warmer water entering recirculation area 76 thus assists in melting the slush in recirculation area 76.

Figure 12:
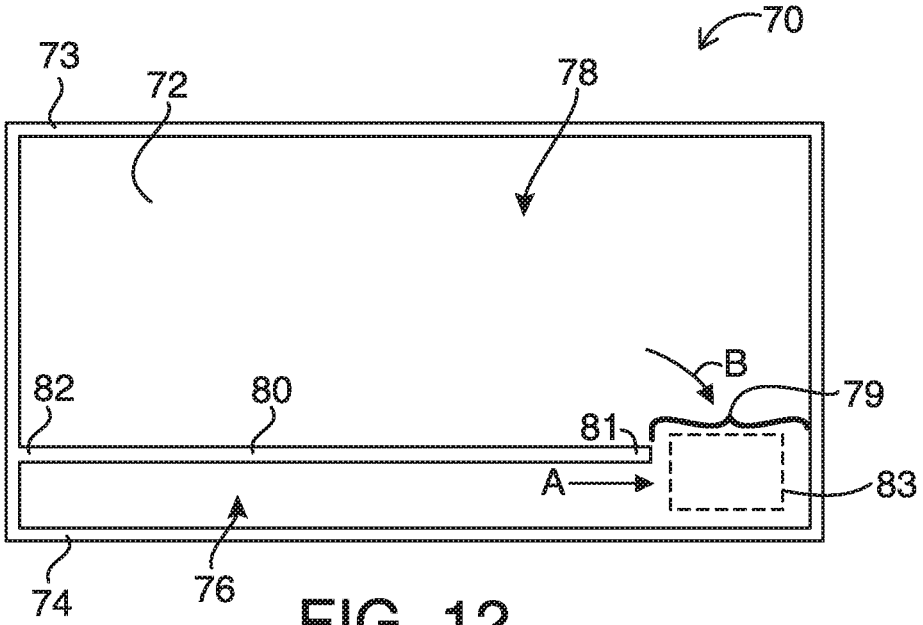
FIG. 12 is a top view of a sump of an ice maker according to one embodiment of the present invention.

Turning now to FIG. 12, another embodiment of sump 70 is shown where there is no second passageway 84 between wall 73 and baffle 80. Water pump 62 and/or an inlet to water pump 62 may be located in area of sump 70 bounded by box 83 and may be disposed such that water pump 62 primarily draws and recirculates water from recirculation area 76 as illustrated by arrow A. If and/or when the recirculated water in recirculation area 76 freezes into slush, baffle 80 permits water pump 62 to draw the warmer water from additional area 78 through first passageway 79 as illustrated by arrow B. In this particular embodiment, warmer water will not be drawn from additional area 78 into recirculation area along arrow C as shown in FIGS. 4A, 4B, 5A, 5B, 6A, 6B, 7A, 7B, 8 and 13.

Figure 15A:
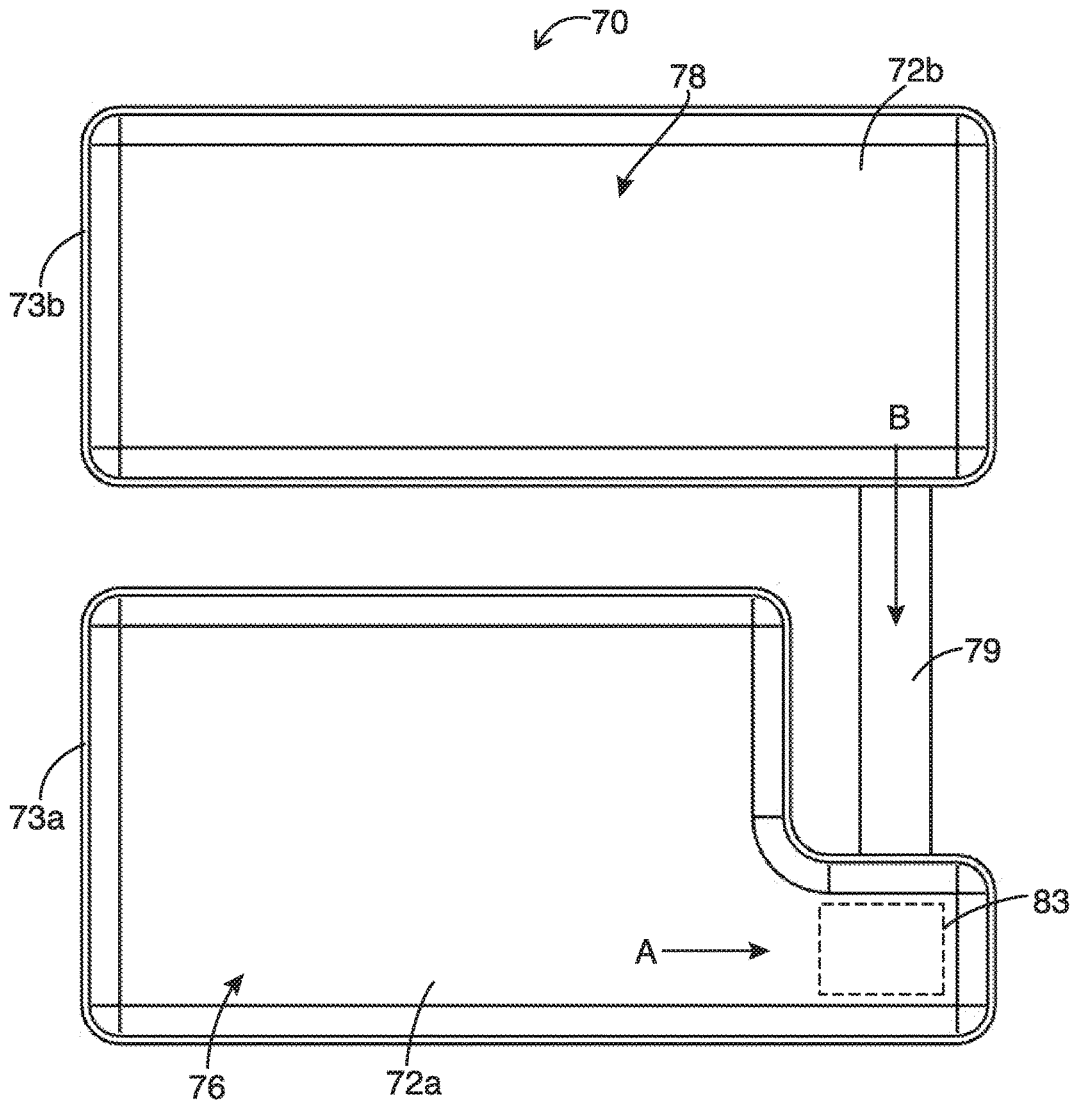
FIG. 15A is a top view of a sump of an ice maker according to one embodiment of the present invention.
Figure 15B:
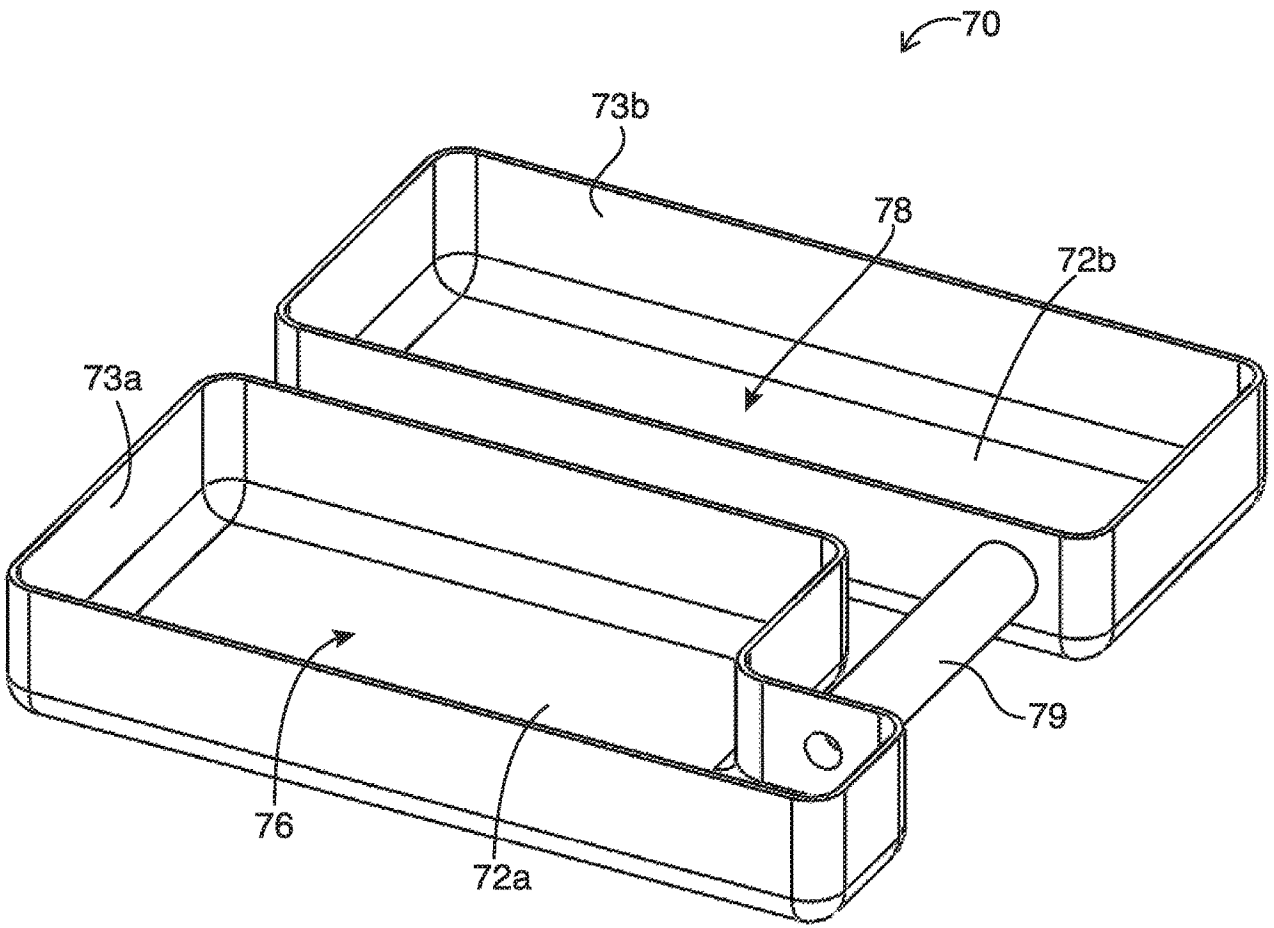
FIG. 15B is a right perspective view of a sump of an ice maker according to one embodiment of the present invention.

Turning now to FIGS. 15A and 15B another embodiment of sump 70 is described in detail. Recirculation area 76 may comprise a bottom 72*a* and a wall 73*a* extending therefrom such that recirculation area 76 can hold a first portion of water. Additional area 78 may also comprise a bottom 72*b* and a wall 73*b* extending therefrom such that additional area 78 can hold a second portion of water. Additional area 78 may be dimensioned such that the volume of additional area 78 is greater than the volume of recirculation area 76 such that additional area 78 may be adapted to hold a greater portion of the mass of water than the portion of mass of water in recirculation area 76 (i.e., the mass of water in additional area 78 may be greater than the mass of water in recirculation area 76). As previously described, in various embodiments, the volume of additional area 78 may be about 1 to about 5 times the volume of recirculation area 76. This can aid in keeping the sensible energy of the water in additional area 78 higher than the sensible energy of the water in recirculation area 76. Therefore, certain embodiments of sump 70 may have one or more walls 73. Additionally, in certain embodiments, recirculation area 76 may be separated from additional area 78. Fluid communication between recirculation area 76 and additional area 78 is provided by first passageway 79. Accordingly, it will be understood that, embodiments of first passageway 79 may comprise any structure which permits fluid communication between recirculation area and the one or more additional areas (e.g., additional area 78) without departing from the scope of the present invention. Thus, for example, first passageway 79 may include, but is not limited to, square, round, oval, rectangular tubing or piping. If and/or when the recirculated water in recirculation area 76 freezes into slush, water pump 62 can draw the warmer water from additional area 78 through first passageway 79 as illustrated by arrow B. While slush held in recirculation area 76 may still be drawn toward water pump 62 (as illustrated by arrow A), the water pump will primarily draw the warmer water from additional area 78 through passageway 79 (as illustrated by arrow B). As a result, water pump 62 tends not to clog, and the recirculation of water can continue permitting the continued making of ice. The slush that forms in recirculation area 76 will be warmed as the warmer water from additional area 78 mixes with the slush near water pump 62. Water pump 62 will then pump the warmer water from additional area 78 through water line 63 and distributor manifold or tube 66, melting any slush that formed therein. The warmer water from additional area 78 will then flow over freeze plate 60; cooling slightly. The slightly cooled warmer water will then fall into sump 70 in recirculation area 76 where it will melt the slush that formed therein.

While sump 70 has been illustrated as rectangular in shape, it will be understood that in other embodiments sump 70 may be any shape without departing from the scope of the present invention. Additionally, in some embodiments, sump 70 may be non-removable from ice maker 10, while in other embodiments sump 70 may be removable from ice maker 10. The ability to remove sump 70 from ice maker 10 may enable easier cleaning of sump 70.

Accordingly, it will be understood that certain embodiments of the present invention can include any combination of one or more baffles 80 disposed parallel to a front portion 74 of wall 73, one or more baffles 80 disposed at an angle Θ with respect to front portion 74 of wall 73, one or more curved baffles 80, the proximal end 81 of one or more baffles 80 connected to wall 73 by wall 86 with wall 86 including one or more passageways 88 disposed at or near the bottom of wall 86, the distal end 82 of one or more baffles 80 terminating at a distance from wall 73 such that a passageway 84 is formed by the gap between distal end 82 of baffle 80 and wall 73, and/or the distal end 82 of one or more baffles 80 terminating at or connected to wall 73 and one or more passageways 84 disposed in baffle 80 at or near distal end 82 of baffle 80.

Thus, there has been shown and described novel methods and apparatuses of an ice maker with an improved sump, which overcome many of the problems of the prior art set forth above. It will be apparent, however, to those familiar in the art, that many changes, variations, modifications, and other uses and applications for the subject devices and methods are possible. All such changes, variations, modifications, and other uses and applications that do not depart from the spirit and scope of the invention are deemed to be covered by the invention which is limited only by the claims which follow.

The invention claimed is:

1. A sump for use in an ice maker, the sump adapted to hold a mass of water, wherein the ice maker freezes some or all of the mass of water into ice, the sump comprising:

a bottom and a wall extending from the bottom, the wall having a front portion;

a recirculation area;

one or more additional areas separated from the recirculation area, wherein the recirculation area and the one or more additional areas are in fluid communication via one or more passageways; and one or more baffles separating the recirculation area and the one or more additional areas, each of the one or more baffles having a distal end connected to the wall and a proximal end spaced from the wall to form the one or more passageways.

2. The sump of claim 1, wherein the one or more baffles is disposed parallel to the front portion of the wall.

3. The sump of claim 1, wherein the one or more baffles is disposed at an angle with respect to the front portion of the wall.

4. The sump of claim 1, wherein:

the recirculation area has a first volume such that the recirculation area is adapted to hold and receive a first portion of the mass of water, the first portion having a first mass of water; and wherein the one or more additional areas have a second volume greater than the first volume such that the one or more additional areas are adapted to hold a second portion of the mass of water, the second portion having a second mass of water greater than the first mass of water.

5. The ice maker of claim 1, wherein the recirculation area is closer to the front portion of the wall than the one or more additional areas.

6. An ice maker for forming ice using a refrigerant capable of transitioning between liquid and gaseous states, the ice maker comprising:

(i) a compressor;

(ii) a condenser;

(iii) a thermal expansion device;

(iv) an evaporator assembly;

(v) a freeze plate thermally coupled to the evaporator assembly;

(vi) a sump located below the freeze plate adapted to hold a mass of water, wherein the ice maker freezes some or all of the mass of water into ice, the sump comprising:

(a) a bottom and a wall extending from the bottom, the wall having a front portion;

(b) a recirculation area having a first volume such that the recirculation area is adapted to hold and receive a first portion of the mass of water, the first portion having a first mass of water, (c) one or more additional areas separated from the recirculation area, wherein the one or more additional areas have a second volume such that the one or more additional areas are adapted to hold a second portion of the mass of water, the second portion having a second mass of water, wherein the recirculation area and the one or more additional areas are in fluid communication via one or more passageways; and (d) one or more baffles separating the recirculation area and the one or more additional areas, each of the one or more baffles having a distal end connected to the wall and a proximal end spaced from the wall to form the one or more passageways; and (vii) a water pump which, during a cooling cycle, pumps the first portion of water from the recirculation area over the freeze plate wherein the first portion of water is cooled as it contacts the freeze plate and wherein some or all of the first portion of water falls into the recirculation area of the sump.

7. The ice maker of claim 6, wherein the one or more baffles is disposed parallel to the front portion of the wall.

8. The ice maker of claim 6, wherein one or more baffles is disposed at an angle with respect to the front portion of the wall.

9. The ice maker of claim 6, wherein if the first portion of water in the recirculation area forms into slush, the second portion of water in the one or more additional areas can be recirculated in the ice maker to melt the slush.

10. The ice maker of claim 6, wherein the first portion of water has a first sensible energy and wherein the second portion of water has a second sensible energy and wherein the second sensible energy is higher than the first sensible energy.

11. The ice maker of claim 6, wherein the first portion of water has a first temperature and the second portion of water has a second temperature and wherein the second temperature is higher than the first temperature.

12. The ice maker of claim 6, wherein the second volume of the one or more additional areas is greater than the first volume of the recirculation area such that the second mass of water is greater than the first mass of water.

13. The ice maker of claim 6, wherein the front portion of the wall is generally parallel to the freeze plate.

14. The ice maker of claim 7, wherein the front portion of the wall and the one or more baffles are generally parallel to the freeze plate.

15. The ice maker of claim 14, wherein the recirculation area is closer to the front portion of the wall than the one or more additional areas.

16. The ice maker of claim 6, wherein the recirculation area is closer to the front portion of the wall than the one or more additional areas.

17. The ice maker of claim 6, wherein the freeze plate is generally aligned with the recirculation area such that water flowing over the freeze plate and into the sump is captured in the recirculation area to be recirculated over the freeze plate.

* * * * *